United States Patent [19]

Larson

[11] Patent Number: 4,979,371

[45] Date of Patent: Dec. 25, 1990

[54] REFRIGERATION SYSTEM AND METHOD INVOLVING HIGH EFFICIENCY GAS DEFROST OF PLURAL EVAPORATORS

[75] Inventor: Robert R. Larson, Redmond, Wash.

[73] Assignee: Hi-Tech Refrigeration, Inc., Bothell, Wash.

[21] Appl. No.: 473,218

[22] Filed: Jan. 31, 1990

[51] Int. Cl.[5] ..... F25B 47/02

[52] U.S. Cl. ..... 62/81; 62/278; 62/513

[58] Field of Search ..... 62/81, 155, 234, 277, 62/278, 513

[56] References Cited

U.S. PATENT DOCUMENTS

| | | | |
|---|---|---|---|
| 2,949,750 | 8/1960 | Kramer | 62/196 |
| 3,138,007 | 6/1964 | Friedman et al. | 62/278 |
| 3,234,754 | 2/1966 | Quick | 62/278 |
| 3,316,731 | 5/1967 | Quick | 62/196 |
| 3,427,819 | 2/1969 | Seghetti | 62/278 X |
| 3,513,664 | 5/1970 | Duffney | 62/278 X |
| 3,645,109 | 2/1972 | Quick | 62/196 |
| 4,167,102 | 9/1979 | Willitts | 62/152 |
| 4,437,317 | 3/1984 | Ibrahim | 62/81 |
| 4,599,873 | 7/1986 | Hyde | 62/498 |
| 4,621,505 | 11/1986 | Ares et al. | 62/509 |
| 4,813,239 | 3/1989 | Olson | 62/81 |

*Primary Examiner*—William E. Tapolcai

*Attorney, Agent, or Firm*—Graybeal, Jensen & Puntigam

[57] ABSTRACT

A hot gas defrost type refrigeration system in which refrigerant used to defrost is returned to the system's refrigerant circuit after being collected and reduced in pressure, as by expansion valve means, to a pressure below the pressure in the system's return suction header, then heated as by means involving heat exchange with the system's high pressure refrigerant, the refrigerant used to defrost thus being in a superheated gaseous state and returned to the system's return suction header in such state without risk of introduction of liquid refrigerant to the system's compressor(s).

14 Claims, 3 Drawing Sheets

REFRIGERATION SYSTEM AND METHOD INVOLVING HIGH EFFICIENCY GAS DEFROST OF PLURAL EVAPORATORS

BACKGROUND OF THE INVENTION

1. Field of Invention

The field of this invention is refrigeration. More specifically, the present invention relates to an improved system and method of defrosting low temperature evaporators. As an example the typical retail supermarket or grocery store has many low temperature cases for displaying frozen or refrigerated food. The refrigeration system typically uses a multiplicity of evaporators, a plurality of compressors and one or more condensers. As the evaporators operate at temperatures well below the frost point of water vapor, the evaporators become covered with frost during operation. The frost will build up until the evaporator can no longer function efficiently, so it must be periodically taken out of service and defrosted. The present invention relates to a system and method of using the latent heat of high pressure saturated refrigerant gas to defrost the evaporators sequentially while returning the liquid and gaseous refrigerant to the suction side of the compressor(s) in a more efficient manner than previously possible.

2. Description of Prior Art

There are four basic methods of defrosting evaporators. The first is to simply turn off the evaporator to be defrosted. This method is very slow, only works when the ambient temperature in the area around the evaporator is above 28° F. and may affect the room temperature.

The second method of defrost is to use electric heat. This method is simple but is not an efficient use of energy. The typical way in which electric defrost is accomplished is to put an electric heating element between the evaporator fan and the coil so that warm air is circulated through the coil in order to melt the buildup of frost.

The third method of defrost is to use store air to melt the frost. This method causes ambient air in the store to be blown through the evaporator to accomplish defrost.

The fourth method of defrost is properly called latent heat defrost but is generally known as hot gas defrost. This method uses a change of state in refrigerant, from a saturated gas to a liquid, to heat the evaporator coil from the inside causing the frost to melt. This method, as well as the other three, are all generally known to those skilled in the refrigeration art.

Most commercial hot gas defrost systems presently utilize a pressure reducing valve placed in the high pressure liquid supply conduit so that when an evaporator goes into defrost the liquid being forced out of the evaporator coil is forced into a liquid supply header. A typical system, known commonly as a two pipe system, is disclosed in Ares et al. U.S. Pat. No. 4,621,505. Also commonly known is a three pipe system, generally this type of system is not used due to its higher cost of installation.

One of the problems with the two pipe hot gas defrost system is what to do with the liquid refrigerant in the evaporator and its associated liquid supply line during the defrost cycle. Not only does the liquid refrigerant in the evaporator coil move into the liquid supply conduit but any refrigerant condensed during the defrost cycle, as well as some hot gas, moves into the liquid supply conduit. This can increase the temperature of the supply liquid, causing so-called flash gas as well as introducing hot gas directly into the liquid supply lines of the evaporators not being defrosted. The major problem with this method of defrost is that any time there is a reduction in pressure of the liquid refrigerant, without a corresponding reduction in temperature, the propensity for flash gas to occur is aggravated. In order to avoid flash gas in the liquid supply lines the liquid and gaseous refrigerant outflow from the hot gas defrost should be returned to the refrigeration circuit at a point other than the liquid supply header. The problem of flash gas, especially in conjunction with a hot gas defrost means that utilizes a pressure reducing valve in the liquid supply line, is well known to the art. The nexus of the problem is in how to return the liquid and gaseous refrigerant products of hot gas defrosting back into the normal refrigeration circuit in an efficient manner without disrupting the high and low pressures of the evaporators still operating in the normal refrigeration mode.

Quick U.S. Pat. No. 3,234,754 discloses a hot gas refrigeration defrost system which addresses the problem of utilizing hot gas refrigerant to defrost a number of separate evaporator coils and then return the defrosting refrigerant to the refrigeration circuit as a gas. The system disclosed by Quick, noting particularly FIG. 2 and the accompanying description of the patent, involves use of a heat exchanger, called an intercooler, to evaporate by heat exchange the refrigerant used for defrosting with the heat of vaporization being supplied by the high pressure liquid refrigerant used elsewhere in the system for evaporator cooling. Conversion of the defrosting refrigerant from liquid state to gaseous state occurs in the intercooler in part by such heat exchange and in part by use of an aspirator which introduces a "small quantity" of liquid refrigerant into the gaseous refrigerant being drawn from the intercooler and delivered to the suction side of the compressors. As is well known, and acknowledged by Quick, any liquid introduced to the compressor(s) of the system is "highly undesirable" and it must be said of the Quick defrosting refrigerant reintroduction technique that it is risky in this respect, as a practical matter.

The present invention, however, effectively accomplishes the purpose (reintroduction of the defrosting refrigerant to the system) without risk to the compressor(s) by use of an expansion valve (to reduce the pressure without causing a phase change) on the defrosting refrigerant flowing into the heat exchanger; with the combined use of both the expansion valve and the heat exchanger further ensuring evaporation of the liquid refrigerant, and then delivery of the refrigerant gas to the compressor(s) intake.

Analyzing the Quick defrost system in another respect, in the Quick system, as shown in FIG. 2, the hot gas used to defrost is taken directly from the compressor 110 outlet which results in a high pressure of refrigerant through the evaporator being defrosted, with only slight reduction of pressure in the evaporator. Quick accumulates the refrigerant from the defrosting evaporator in an intercooler 193 with the outtake from the intercooler being in gaseous state only by action of aspirator 197 leading to conduit 196 which in turn delivers the refrigerant to the suction side of compressor 110. Since the intercooler 193 is at high pressure and receives refrigerant in both liquid and gaseous form, and since the only outtake is in gaseous form, the liquid refrigerant will accumulate in the intercooler 193 at least until the aspirator 197 starts introducing some liquid to the compressor(s).

Alternatively, the pressure in intercooler 193 is uncontrolled because aspirator 197 does not control pressure; hence, the pressure increases both in the intercooler 193 and at the suction side of compressor 110 to the point where the compressor efficiency is lost or the compressor overheats due to the high pressure in the suction line.

Another problem with the Quick system that is solved by the present invention is how to return compressor crankcase oil to the compressors. Even with oil separators a sufficient amount of oil is pumped through the refrigeration system that there must be provision for its return. In the Quick system, the oil will collect in the intercooler since there is no means to either evaporate the oil or to return the oil as a liquid. In the present invention, the expansion valve in the return line allows the oil entrapped in the refrigerant to be condensed into a liquid in the subcooler and then returned to the compressor crankcase as a liquid by using a standard P-trap arrangement (not shown).

Quick U.S. Pat. No. 3,645,109 discloses a means for dealing with flash gas by using a chamber in the liquid supply circuit to separate the flash gas from the liquid refrigerant, the flash gas being created by a pressure reducing valve in the liquid supply line and from defrost cycle. In one embodiment, FIG. 5, Quick uses a solenoid valve on the main liquid refrigerant supply line in order to change the pressure in the liquid supply line in order to return the liquid refrigerant collected in the flash gas, liquid refrigerant separation chamber back into the liquid supply line. The present invention does not return any liquid to the liquid supply line, nor is the liquid supply line to all of the system evaporators ever interrupted.

SUMMARY OF INVENTION

A primary object of the present invention is to provide a refrigeration system that utilizes hot gas defrost while allowing the head pressure of the compressors to fluctuate or "float" according to outdoor ambient conditions. This increases the efficiency of the refrigeration system which reduces the total amount of energy used by the system.

Another object of the present invention is to provide a method of defrosting evaporators in a refrigeration system that increases the overall system efficiency by providing a means to effectively return the liquid and gaseous refrigerant from a defrosting evaporator and its associated liquid supply conduit to the refrigeration circuit at a location other than the liquid supply header.

Yet another object of the present invention is to allow hot gas defrost to occur in an evaporator, or a series of evaporators, while at the same time eliminating or substantially reducing the presence of so-called flash gas from occurring in that part of the refrigeration system that is still in refrigeration mode.

A still further object of the present invention is to reduce flash gas by using the liquid produced during defrost to subcool the high pressure liquid supply line.

And yet another object is to allow the use of a refrigerant pump on the liquid supply line, in order to reduce flash gas, while using a two pipe hot gas defrost system.

Yet another object of the present invention is to provide an improved multi-evaporator refrigeration systems for, and method of, diverting liquid refrigerant formed by the defrost action in one evaporator from interfering with the refrigeration action in the rest of the evaporators and doing so safely, i.e. without risking introduction of liquid refrigerant to the compressors.

Further objects and advantages of the present invention will be apparent from the following description and accompanying drawings.

BRIEF DESCRIPTION OF THE DRAWINGS

For illustration and disclosure purposes the invention is embodied in the parts and the combinations and arrangements of parts hereinafter described and claimed. In the accompanying drawings which form a part of the specification and in which like numerals refer to like parts wherever they occur.

DESCRIPTION OF PREFERRED EMBODIMENT

Typically, the present invention is applicable to a closed circuit refrigeration system of the multiplex type having even or uneven, parallel compressors, suitable for installation in a supermarket, or the like, for operating a plurality of separate evaporators, or series of evaporators, such as refrigerated and frozen food storage and display cases. In such a system the coils are defrosted utilizing a two pipe system, with the liquid refrigerant in the evaporator and its associated liquid supply conduit, as well as liquid and gaseous refrigerant produced as a result of defrosting, being returned to the refrigeration circuit at a location other than the liquid supply header and more specifically to the suction side (low pressure side) of the refrigeration system. It will be understood and readily apparent to those skilled in the art that the invention is useful on any low temperature refrigeration system having two or more evaporators that utilize a two pipe supply and return system. The term "high pressure" refers to the system pressure between the compressor(s) outlet side and the inlet side of the expansion valves and the term "low pressure" refers to the system pressure between the outlet side of the expansion valves and the suction port of the compressor(s).

Figure 1:
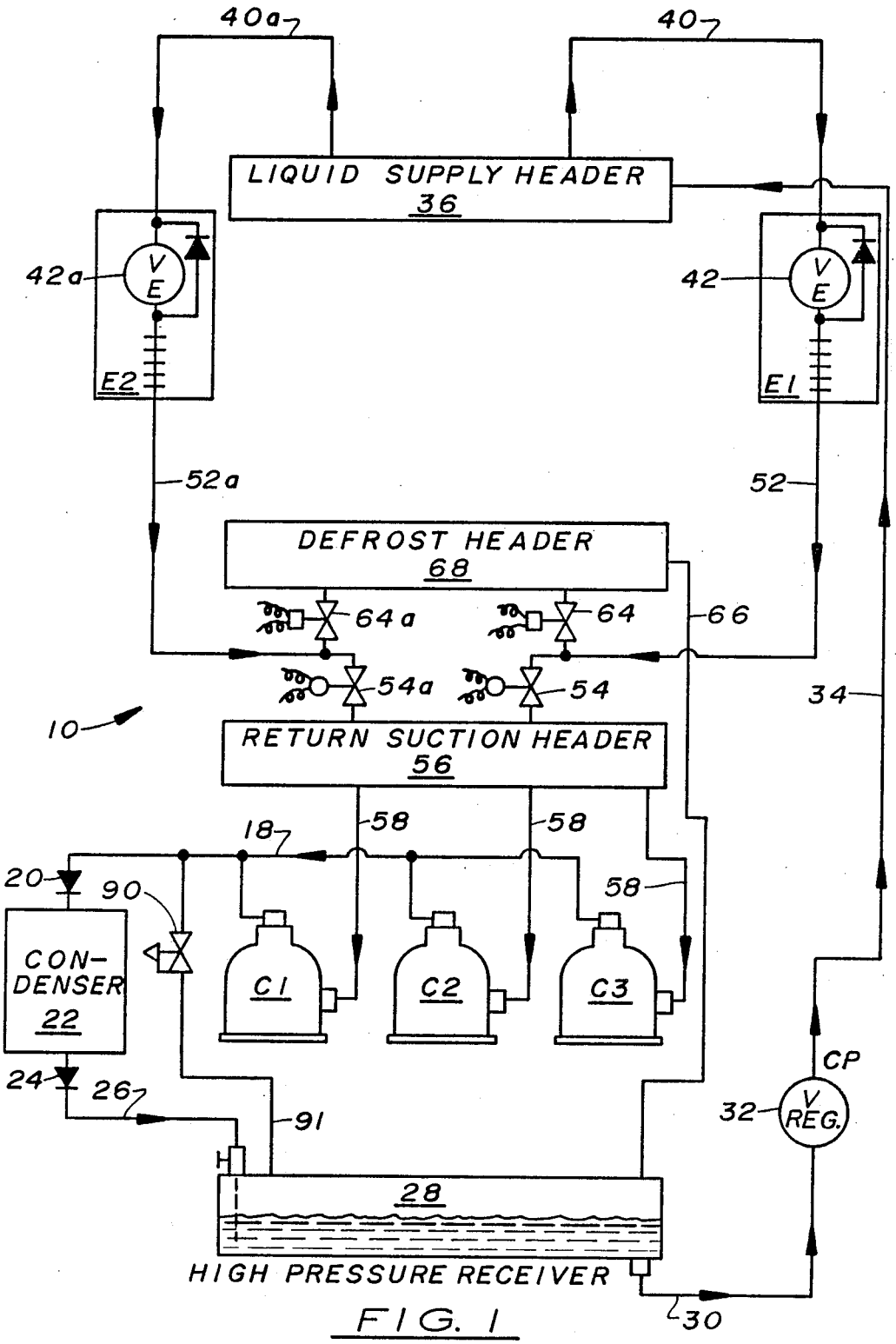
FIG.1 is a diagrammatic view of a typical refrigeration system with plural evaporators depicting the typical prior art method of hot gas defrost. The system is shown in the normal refrigeration mode.

Referring to FIG. 1, a typical refrigeration system is shown with a typical hot gas defrost setup such as disclosed in Ares et al. U.S. Pat. No. 4,621,505. The refrigeration cycle starts when gaseous refrigerant is compressed in compressors C1, C2, C3, which raises both the temperature and the pressure of the refrigerant. The high temperature, high pressure gaseous refrigerant passes through conduit means 18, through check valve 20, and is then condensed into a liquid, at high pressure, in condensing means 22. The high pressure liquid then passes through check valve 24 and flows via conduit means 26 into high pressure receiver 28. The high pressure receiver 28 functions as a reservoir for supplying high pressure, high temperature liquid and high pressure saturated gas to the refrigeration and defrost systems. From the high pressure receiver 28, liquid refrigerant flows through conduit means 30, through pressure regulator 32, which reduces the pressure without a corresponding reduction in temperature and through conduit means 34 into liquid supply header 36. Liquid supply header 36 acts as a distributor or manifold, with a plurality of liquid supply lines coming off it, one to each evaporator in the system. Only two such lines 40 and **40*a* and two evaporators E1 and E2 are shown in FIG. 1, for simplicity. The high pressure liquid flows through conduit means, or lines 40, 40*a* to metering devices, e.g. expansion valves 42, 42*a*, which causes the high pressure liquid refrigerant to expand without changing to a gas, but with a corresponding reduction in temperature. The evaporators E1 and E2 absorb heat from the space surrounding them as the liquid refrigerant boils. The low pressure, low temperature gaseous refrigerant then flows through conduit means 52, 52*a*, and solenoid vales 54, 54*a* into return suction header 56. From return suction header 56 the gaseous refrigerant flows through conduit means 58** to the compressors C1, C2, C3, then repeats the circulation cycle.

The most common prior art means of hot gas defrost is described below, referring to FIG. 1. When evaporator E1 is to be defrosted solenoid valve 54 is closed and solenoid valve 64 is opened. With valve 54 closed the low pressure area of return suction header 56 is shut off. When solenoid valve 64 opens, high pressure saturated refrigerant gas flows from high pressure receiver 28 through conduit means 66 into defrost header 68. The high pressure saturated gas flows through solenoid valve 64 and conduit means 52 into evaporator E1. In order to ensure that saturated gas can flow into evaporator E1, the evaporator to be defrosted, there must be a pressure differential between the defrost header 68 and the liquid supply header 36. Due to the pressure differential the liquid in evaporator E1 and its associated liquid supply conduit 40 is pushed back into the liquid supply header 36. Toward the end of a defrost cycle refrigerant gas is also pushed into the liquid supply header 36. In order to accomplish this the general practice is to place a pressure reducing valve in liquid supply conduit means 30, 34. There are two main disadvantages inherent in this method. The first is that when high pressure liquid from high pressure receiver 28 passes through pressure regulator 32, a reduction in pressure results without a corresponding reduction in temperature, and the probability of flash gas is substantial, which reduces both the refrigeration efficiency and capacity. The probability of flash gas occurring is further aggravated by the introduction of refrigerant gas directly into the liquid supply header 36 when the evaporator E1 is nearing the end of its defrost cycle.

Secondly, since the liquid already in the conduit means 40 and the evaporator E1 is forced back into the liquid supply header 36, the evaporator is slow to start defrosting because the pressure gradient between the defrost header 36 and the liquid supply header 36 is not great enough to rapidly push the aforementioned liquid back into the liquid supply header 36.

Figure 2:
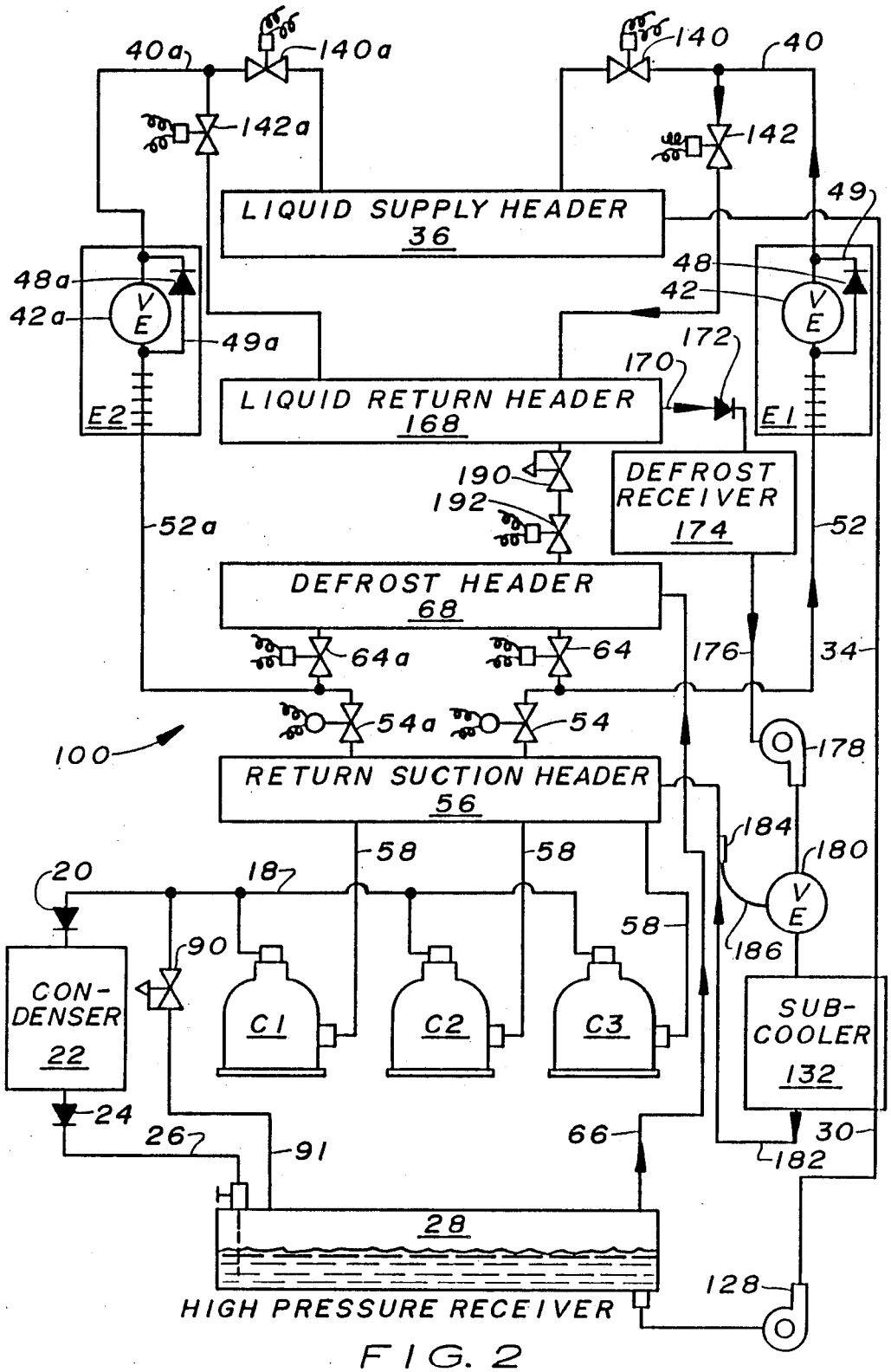
FIG. 2 is a diagrammatic view of the system shown in FIG. 1, with an embodiment of the present invention added, and with one of the evaporators in the defrost mode.

In order to directly compare a typical refrigeration system as illustrated in FIG. 1 with both evaporators E1 and E2 operating in the refrigeration mode with the system of the present invention operating with one of the evaporators E1 in the defrost mode as illustrated in FIG. 2, the showing in FIG. 2 presents a system with the components designated with two digit numbers representing a typical refrigeration system and the additional components of the refrigeration system introduced by the present invention are designated with three digit numbers.

The compressors C1, C2, C3, may be of identical horsepower or of different horsepower and may vary in number. In the case of compressors with different horsepower, referred to commonly as an uneven system, the different horsepower values allow the refrigeration system to closely follow the instantaneous load on the system. The high pressure output from compressors C1, C2, C3, flows through conduit means 18, passes through check valve 20 and is delivered to condenser 22. The high pressure refrigerant gas being supplied by compressors C1, C2, C3, is condensed to a high pressure liquid in the condenser 22, which is usually air cooled or evaporatively cooled, although it may be water cooled. The high pressure liquid leaves the condenser 22, passes through check valve 24, through conduit means 26 and flows into high pressure receiver 28. The high pressure receiver 28 functions as a reservoir for supplying high pressure liquid and saturated high pressure gas to the system. In the preferred embodiment, refrigerant pump 128 acts to increase the pressure of the high pressure liquid refrigerant with essentially no increase in temperature and serves to prevent flash gas, as taught by Hyde, U.S. Pat. No. 4,599,873. The refrigerant pump 128 allows the head pressures of the compressors C1, C2, C3 to fluctuate according to the outside weather conditions while maintaining a minimum liquid supply pressure. Refrigerant booster pump 128 could not be used on a typical hot gas defrost set-up as depicted in Aires et al., U.S. Pat. No. 4,621,505, because the pressure reducing valve (41, FIG. 1) would cancel out the effect of the booster pump. From the high pressure receiver 28 high pressure liquid moves through refrigerant pump 128, through conduit means 30 and through subcooler 132 where the high pressure liquid is cooled to help prevent flash gas before flowing through expansion valves 42, **42*a*. On a summer day the high pressure liquid is approximately 95° F. before entering subcooler 132. In subcooler 132, the high pressure liquid refrigerant is cooled to approximately 55° F. whenever there is liquid refrigerant passing through the subcooler 132 from the defrost receiver 174. On a cooler day, or at night, when the ambient air is approximately 50° F., the head pressure of the compressors C1, C2, C3, will be approximately 97 psig, which corresponds to a temperature of 55° F. After passing though the subcooler 132, the high pressure liquid refrigerant will be approximately 35° F. The heat absorption side of subcooler 132** is discussed later.

The high pressure liquid refrigerant then flows via conduit means 34 into liquid supply header 36 . From the liquid supply header 36, high pressure liquid refrigerant is distributed to conduits 40, **40*a*, with solenoid valves 140, 140*a* placed in conduit means 40, 40*a* in order to interrupt the flow of liquid refrigerant during defrost mode. The high pressure liquid refrigerant then flows to thermal expansion valves 42, 42*a*. During the normal refrigeration cycle, the high pressure refrigerant expands through conventional expansion valves 42, 42*a*, which causes a reduction in pressure with a corresponding reduction in refrigerant temperature. Check valves 48, 48*a* prevent the refrigerant from flowing through the by-pass conduits 49, 49*a*. The liquid refrigerant then goes through a phase change, by boiling, as it absorbs heat from air passing over the evaporator coil surfaces. Once the liquid refrigerant changes into a gas it flows through conduits 52, 52***a* and through solenoid valves 54, 54*a* into the return suction header 56. The gaseous refrigerant then passes through conduits 58, and into compressors Cl, C2, C3. This completes the normal refrigeration cycle for the typical commercial system selected for purposes of illustrating an application of the present invention. The primary difference is the removal of pressure regulating valve 32 (FIG. 1) and the addition of means to efficiently return liquid refrigerant to the return suction header 56.

DEFROST MODE

When an evaporator becomes covered with frost the system efficiency is reduced and the evaporator is not able to maintain the desired temperature in the space. Frost is formed whenever the evaporator temperature is below the frost point of the air in the surrounding space.

Figure 3:
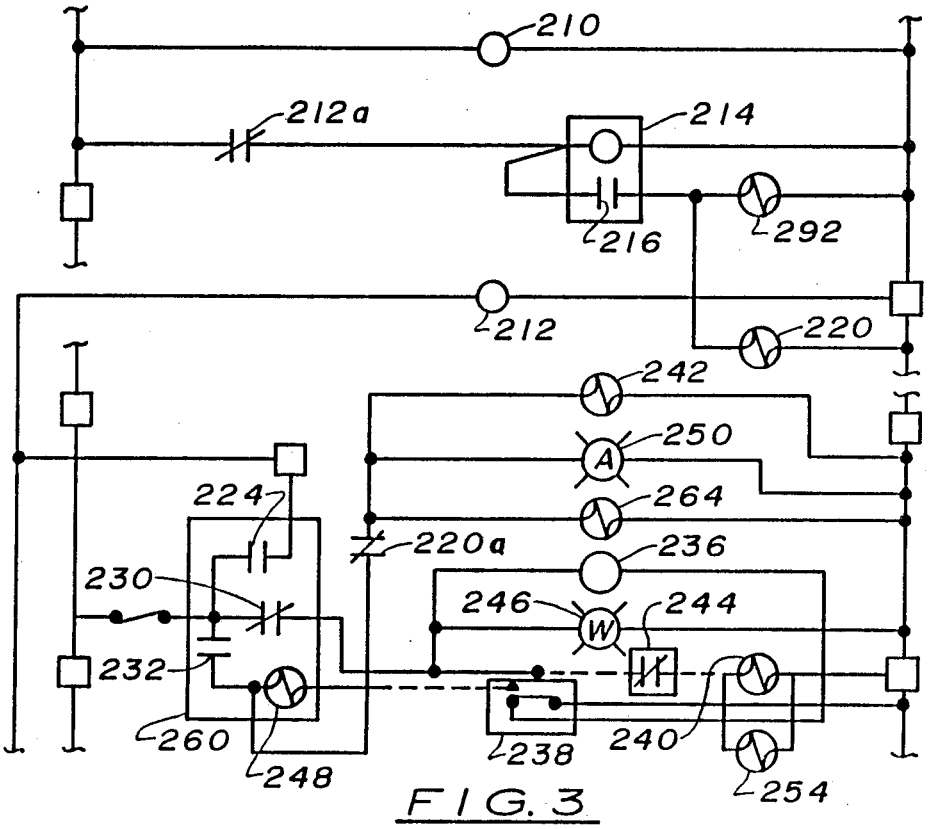
FIG. 3 is a ladder diagram of that portion of the electrical control system associated with one of the evaporators of the system illustrated in FIG. 2, with the evaporator in the normal refrigeration mode.

As depicted in FIG. 2, when the defrost cycle starts, usually controlled by a defrost controller (as shown in FIG. 3 and later described), the liquid refrigerant flow to evaporator E1, which is to be defrosted, is interrupted by closing solenoid value 140 and closing suction line solenoid valve 54. At the same time, solenoid valve 64 is opened, allowing hot gas from the high pressure receiver 28 to flow through conduit 66 into defrost header 68, then through solenoid valve 64 into conduit 52 which delivers high pressure hot gas to the evaporator El, causing it to heat up and melt the frost on its exterior.

At the same time that solenoid valve 64 is opened, solenoid valve 142 is also opened. When solenoid valve 142 is opened, the pressure of the hot gas entering evaporator E1 forces any cold liquid refrigerant left in the evaporator E1 out of the evaporator E1 and through check valve 48, into conduit 40. The cooled refrigerant mixes with the hot liquid refrigerant in conduit 40 and is pushed back through solenoid valve 142, through conduit 166, and into the liquid return header 168. Upon initiation of a defrost cycle, the liquid return header 168 will be at the same pressure as the low pressure side of the refrigeration system. Due to the low pressure in the liquid return header the liquid from evaporator E1 will flow very quickly into the liquid return header due to the large differential of pressures between the defrost header 68 and the liquid return header 168. From liquid return header 168 the liquid refrigerant flows through conduit 170, through check valve 172 and into a defrost receiver 174. In a typical installation the conduit 40 is substantial in length with the liquid return header being located in a machinery room and with the evaporators being located in the display area of the supermarket. Because of the length of conduit 40 the collection means, comprising the liquid return header 168 and the defrost receiver 174, must be of substantial size and large enough to contain all of the liquid refrigerant being delivered. From the defrost collection means 174 the liquid refrigerant flows through conduit 176 to refrigerant booster pump 178, then to expansion valve 180. In the preferred embodiment refrigerant booster pump 178 is optional and is used to increase the pressure of the refrigerant to eliminate flash gas in like manner as taught by Hyde, U.S. Pat. No. 4,599,873.

After the refrigerant expands through expansion valve 180 the refrigerant enters subcooler 132 which functions as an evaporative type heat exchanger and cools the hot liquid refrigerant in conduit 30 which is flowing from the high pressure receiver 28 to the liquid supply header 36. The subcooler 132 cools the hot refrigerant, thus improving the overall efficiency and capacity of the refrigeration system. The refrigerant gas thus generated in the subcooler 132 is pulled through conduit 182 into the return suction header 56 and, via conduits 58, back into the normal refrigeration circuit.

Continuing with the example, the refrigerant pressure on the upstream side of the variable flow expansion valve 180 is approximately 7 psig. The refrigerant pressure at the outlet side of the expansion valve (metering device) drops to −25° F. which corresponds to a pressure of approximately 12 psig. Since the liquid refrigerant drops to −25° F., after passing through the expansion valve 180 it absorbs heat from the liquid refrigerant in the liquid supply line 30, which has a temperature of approximately 60° F. After absorbing heat from the liquid refrigerant in the liquid supply line 30, the refrigerant in line 182 on the low pressure side of the subcooler 132 leaves the subcooler 132 at a temperature of approximately −5° F. A short distance downstream, the refrigerant gas in line 182 picks up 10° F. of superheat from the ambient air around line 182. The amount of superheat is controlled by the temperature sensing bulb 184 attached to line 182 a short distance downstream of subcooler 132 and communicates the temperature of the refrigerant gas in line 186 to the variable flow expansion valve 180 via capillary tube 186. As will be recognized, sensor bulb 184 and capillary tube 186 are conventional components associated in a conventional manner with expansion valve 180. Thus, considered generally, it will be seen that the liquid refrigerant is reduced in pressure, with a corresponding reduction in temperature, such reduction being to a pressure such that, after the refrigerant is heated and the pressure increased in the course of its heat exchange with the high pressure liquid refrigerant in subcooler 132 and in the course the refrigerant delivery to the compressor means, it reaches the suction side of the compressor means in superheated gaseous state.

As the liquid refrigerant is evaporated into a gas, any oil entrapped in the refrigerant condenses and forms liquid oil, which is collected in a standard P-trap at the outlet side of the subcooler 132 and is returned to the compressor(s) crankcase in the standard manner.

In order to allow for a preset minimum pressure to be maintained in the high pressure receiver, even during winter operation when the outside ambient temperature is low, pressure regulating valve 90 and conduit means 91 are provided so that the condenser 118 may be bypassed. This ensures that enough heat is available in the high pressure receiver 28 to achieve defrost and that there is sufficient pressure in the high pressure receiver 28 to enable the liquid refrigerant to be pushed through the entire refrigeration circuit. The typical minimum pressure to be maintained in the high pressure receiver is 97 psig. which corresponds to temperature of 55° F.

In order to return evaporator E1 to the normal refrigeration mode as quickly as possible, solenoid valves 64, 142 are closed as soon as the evaporator coil is defrosted. Since there may still be liquid refrigerant in the liquid return header 168 and/or in the defrost receiver 174, the liquid return header 168 must remain pressurized when solenoid valves 142 and 64 close, while solenoid valves 140 and 54 open, returning evaporator El to the refrigeration mode. In order to maintain the pressure in the liquid return header 168, solenoid valve 192 is opened, allowing the high pressure gas from the defrost header 68 to flow through pressure regulating valve 190 into the liquid return header 168, which in turn maintains the pressure in the defrost receiver 174, allowing the liquid refrigerant stored therein to continue to flow through expansion valve 180 into the liquid subcooler 132. Once the liquid in the defrost receiver 174 is gone, solenoid valve 192 is closed and the next evaporator E2 may begin its defrost cycle. After solenoid valve 192 is closed, the pressure in the liquid return header 168 and the defrost receiver 174 return to the same pressure as is in the low pressure side.

While only two evaporators E1 and E2 are shown, it will be self-evident that commercial refrigeration systems often involve a large number of evaporators which are to be defrosted in sequence, and that the invention is applicable to any such system.

CONTROL OF DEFROST SYSTEM OF THE PRESENT INVENTION

Figure 4:
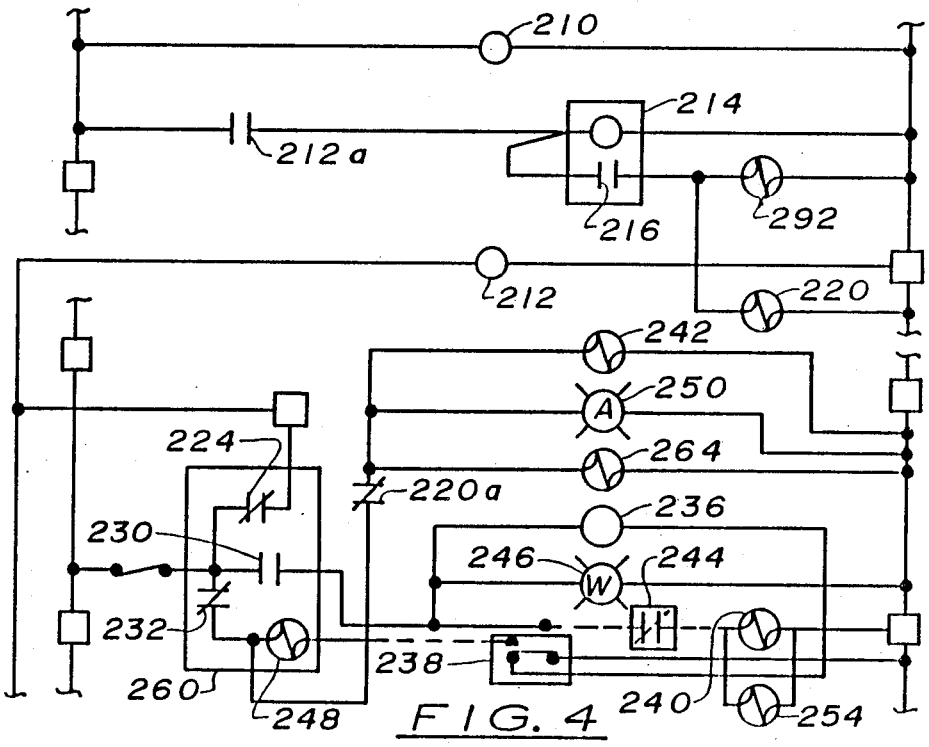
FIG. 4 is a ladder diagram of that portion of the electrical control system associated with one of the evaporators of the system illustrated in FIG. 2, with the evaporator in the defrost mode.

Typical electrical controls, as they pertain to the illustrated embodiment of the invention, are shown in FIGS. 3 and 4. A typical defrost control timer is Paragon model number A-877-00. The control system associated with a given evaporator is depicted in a normal refrigeration mode in FIG. 3. Contact 212 is normally closed and time delay relay 214 will have timed out, leaving contact 216 open. This in turn leaves solenoid 292 de-energized, leaving valve 192 (FIG. 2) closed and coil 220 de-energized, which leaves contact **220*a* in its normally closed position, as it should be during normal refrigeration periods. During normal refrigeration mode, timer 260 has contact 230 normally closed and contacts 224 and 232 normally open. With contact 230 closed the evaporator fan motor control 236 is energized so that, when the defrost termination thermostat 238 is in the closed position as shown, the evaporator fan motor runs, which in turn provides the air movement required by the evaporator E1. Light 246 is an indicator light indicating that the system is in normal refrigeration mode. With contact 230 closed, power is also delivered to room thermostat 244, which is open or closed depending on the temperature in the space being cooled. When thermostat 244 is closed, solenoids 240, 254 are energized, with the result that valves 140, 54 (FIG. 2) open, allowing the normal flow of refrigerant through the system. In general, the defrost control system as shown in FIG. 4 has a common timer motor 210 that drives a plurality of timing wheels, not shown. Each timing wheel is calibrated so that one revolution of a wheel is equal to twenty-four hours. Each timing wheel is associated with one timer 260, which has its own set of contacts 224, 230, 232**. Each timing wheel has places for pins to be placed in the wheels so the time of each defrost cycle for each evaporator can be set according to placement of pins in each wheel. There is a timing wheel for each evaporator in the system.

When a timing wheel pin trips the contacts, contact 230 opens and contacts 224 and 232 close. Since contact **220*a* is normally closed contact and since coil 220 is de-energized, contact 220*a* remains closed during the defrost period. By opening contact 230 the evaporator fan motor control 236 is de-energized which turns off the evaporator fan so as to reduce the amount of heat transferred to the space during the time that the evaporator is being heated in order to clear the frost buildup. Running light 246 goes off and thermostat 244 is de-energized. Solenoids 240 and 254 are also de-energized, thereby closing their associated valves 140, 54 and thereby interrupting the normal refrigerant flow. When contact 224 closes coil 212 is energized which opens contact 212*a*, the consequence of which will become clear later in the sequence. When contact 232 is closed solenoid 242 is energized thereby opening the liquid return solenoid valve 142 (FIG. 2). At the same time, solenoid 264 is energized, thereby opening hot gas solenoid valve 64 (FIG. 2). The opening of solenoid valves 142 and 64 places the evaporator into defrost mode, which is indicated by light 250 being illuminated due to contact 232** being closed.

The defrost mode may be terminated in one of two ways. The fail safe method is by pins in the timer 260 being set so that the defrost cycle ends at a preset time, whether the evaporator coil had completely defrosted before this time or has not been completely defrosted The pins in the timer 260, change contacts 224, 230 and 232 back to their normal refrigeration mode positions, which means that contacts 224 and 232 are opened while contact 230 is closed. A second and preferred method of ending the defrost cycle is to use a defrost termination thermostat switch 238. When the defrost termination thermostat switch 238 heats up, normal contact is broken and solenoid 248 is energized. When solenoid 248 is energized, contacts 224, 232 move to the open position and contact 230 is closed.

Whichever method is used to terminate defrost, when contact 232 opens, solenoids 242, 264 are de-energized, causing solenoid valves 142, 64 to close, which ends the defrosting of the evaporator. At the same time, contact 224 has opened, thereby de-energizing coil 212 which in turn allows contact **212*a* to return to its normally closed position. When contact 212*a* closes, the time delay relay 214 starts its cycle by closing contact 216. Time delay relay 214 is suitably an adjustable relay that will hold contact 216 closed for less than one minute to more than 20 minutes. When contact 216 closes, solenoid 292 is energized which opens solenoid valve 192. At the same time, coil 220 is energized which causes contact 220*a* to open. With contact 220 *a*** open, none of the remaining evaporators in the refrigeration system can start a defrost cycle.

Once defrost termination thermostat 238 returns to its normal position as shown, the evaporator fan motor control turns the evaporator fan back on and the evaporator is returned to refrigeration mode. After time delay relay 214 has timed out, i.e. one to twenty minutes time has elapsed, contact 216 opens, de-energizing solenoid 292 and coil 220. Once solenoid 292 is de-energized, valve 192 closes which means that the system is ready to accept the liquid refrigerant from another evaporator's defrost cycle. When coil 220 is de-energized contact **220*a*** returns to its normally closed position which allows another evaporator to go into a defrost cycle.

As will be apparent, while only two evaporators El, E2 are shown in the system schematically illustrated in FIG. 1, any selected number of evaporator branch systems or modules can be utilized in any given system, with refrigeration mode liquid supply from the common liquid supply header, with return to the common return suction header and with the liquid return header and defrost header in common with the various evaporator branches.

As will be also understood, the cycle time for each evaporator defrost cycle is a somewhat limiting factor as to the number of the evaporators which can be multiplexed in any given system and is limited to roughly sixty evaporators if the evaporators are defrosted individually and in sequence. However, in a multiplex refrigeration system involving an even larger number of evaporators it is possible to defrost two or more evaporators in parallel with the capacity of the associated defrost header, liquid return header, defrost receiver and subcooler being increased accordingly.

While particular embodiments of this invention have been shown in the drawing and described above, it will be apparent that further adaptations may be made in the form, arrangement and location of the various elements of the system. In consideration thereof, it should be appreciated that preferred embodiments of this invention, disclosed herein, are intended to be illustrative only and not intended to limit the scope of the invention as defined by the following claims.

What is claimed is:

1. In a refrigeration system involving recirculation of a refrigerant from a high pressure receiver through a liquid supply header, then in parallel flow via conduit means through plural evaporators, then through a return suction header, compressor means, and condenser means back to the high pressure receiver when the evaporators in the system are operating in refrigeration mode, the method of defrosting each evaporator in the system without interfering with the refrigeration action in the rest of the system, comprising:

introducing high pressure refrigerant gas in reverse flow through a given evaporator being defrosted and its associated liquid supply conduit means until said evaporator is substantially defrosted, returning all of the liquid refrigerant flowing from said evaporator and its associated liquid supply conduit means to the low pressure side of the refrigerant circulation circuit as a superheated gas so as to prevent the risk of any liquid returning to said compressor means while simultaneously increasing the efficiency of the refrigeration system by passing the liquid refrigerant being supplied from the high pressure receiver in heat exchange relationship with cooling the liquid refrigerant being supplied to the evaporators that remain in the refrigeration mode, returning said liquid refrigerant without interrupting the flow or reducing the pressure of said refrigerant flowing through the high pressure side of said refrigeration system, and thereafter initiating the defrosting of the next evaporator of the system to be defrosted by like high pressure saturated refrigerant gas introduction thereto.

2. The method of claim 1, comprising returning any oil entrapped in the liquid refrigerant by condensing said oil out of the refrigerant and returning said oil to the compressor means.

3. The method of claim 1, wherein said method of introducing high pressure saturated refrigerant gas in reverse flow through the given evaporator comprises:

interrupting the flow of refrigerant through said given evaporator and its associated liquid supply conduit means while maintaining liquid refrigerant flow through the other evaporator(s) in the system at the same or greater pressure as is in the high pressure receiver, and delivering saturated refrigerant gas from the high pressure receiver to a defrost header, then through said given evaporator and its associated liquid supply conduit in reverse flow.

4. The method of claim 1, wherein the method of returning liquid refrigerant in said given evaporator and its associated conduit means to the low pressure side of the refrigerant circulation circuit comprises:

(a) collecting the liquid and gaseous refrigerant return from the defrosting evaporator in a collection means that is at a pressure equal to the pressure in the low pressure side of the refrigeration circuit at the start of the defrost cycle, and (b) reducing the collected refrigerant in pressure, with a corresponding reduction in temperature, such reduction being to a pressure so that, after the refrigerant is heated and the pressure increased in the course of its heat exchange with the high pressure liquid refrigerant and in the course of the delivery of the refrigerant to the compressor means, it reaches the return suction header in superheated gaseous state.

5. In a refrigeration system involving recirculation of a refrigerant from a high pressure receiver through a liquid supply header, then in parallel flow through plural evaporators, then through a return suction header, compressor means, and condenser means back to the high pressure receiver when the evaporators in the system are operating in refrigeration mode, the method of defrosting each evaporator in the system comprising:

(a) interrupting the flow of refrigerant through the first evaporator to be defrosted without interfering with the flow through the other evaporator(s) in the system, (b) delivering saturated refrigerant gas from the high pressure receiver to a defrost header and through the first evaporator in reverse flow for a time sufficient to substantially defrost the evaporator, (c) delivering the outflow from the evaporator and its associated liquid supply conduit to a collection means that at the start of the defrost cycle has a pressure equal to the pressure in the low pressure side of the refrigeration circuit, (d) reducing the collected refrigerant in pressure with a corresponding reduction in temperature and passing the collected refrigerant in heat exchange relationship with refrigerant being supplied from the high pressure receiver to the evaporators that remain in the refrigeration mode, such reduction being to a pressure so that, after the refrigerant is heated and the pressure increased in the course of its heat exchange with the high pressure liquid refrigerant and in the course of the refrigerant delivery to the compressor means, it reaches the return suction header in superheated gaseous state, (e) maintaining such flow of refrigerant from the defrost receiver to the suction side of the compressor(s) until substantially all refrigerant in liquid state is exhausted from the collection means, (f) re-establishing the defrosted evaporator in refrigeration mode when substantially free from frost, and (g) repeating steps (a), (b), (c), (d), (e), and (f) for each evaporator in the system in sequence.

6. The method of claim 5, wherein the refrigerant flow from the collection means to the compressor means is maintained by pressurizing the refrigerant in the collection means by delivering refrigerant gas to the collection means at high pressure from the defrost header.

7. The method of claim 5, further comprising increasing the pressure without increasing the temperature of the refrigerant flowing from the high pressure receiver to the liquid supply header to minimize generation of flash gas.

8. A refrigeration system comprising recirculation of refrigerant from a high pressure receiver through a liquid supply header, then through plural evaporators, a return suction header, compressor means, and condenser means and back to the high pressure receiver when the evaporators in the system are operating in the refrigeration mode, the improvement whereby each evaporator in the system is defrosted in sequence without the defrosting of any given evaporator interfering in the refrigeration action in the other evaporator(s) in the system and without risk of introduction of liquid refrigerant to the compressor means of the system, such system further comprising:

(a) a defrost header, (b) means delivering hot refrigerant gas from the high pressure receiver to said defrost header and in reverse flow through a first evaporator for a time sufficient to substantially defrost the evaporator, (c) refrigerant collection means and means delivering the refrigerant outflow from the evaporator being defrosted to the collection means, (d) means reducing the pressure and consequently the temperature of the collected refrigerant sufficiently so that the refrigerant is in liquid state and at a pressure substantially less than the pressure in the return suction header, (e) means heating the collected and cooled liquid refrigerant to render such in superheated gaseous state including heat exchange means in which the refrigerant from defrost is heated by refrigerant flowing from the high pressure receiver to the liquid supply header, (f) means delivering the resulting superheated gaseous refrigerant to the return suction header, (g) means pressurizing the refrigerant in the collection means to maintain the flow therefrom to the return suction header until substantially all of the refrigerant in liquid state is exhausted from the collection means, (h) such refrigeration system further comprising means reestablishing the defrosted evaporator in the refrigeration mode when substantially free from frost, and (i) means controlling refrigerant flow in the system so as to defrost each evaporator thereof in like manner in sequence.

9. The system of claim 8, wherein said collection means comprises a liquid return header and a defrost receiver.

10. The system of claim 8, wherein said heat exchange means is a subcooler.

11. The system of claim 10, wherein said means reducing the pressure and temperature of the refrigerant from defrost comprises a variable flow expansion valve.

12. The system of claim 11, in which the flow rate of the refrigerant through said expansion valve is governed by the temperature of the refrigerant gas being delivered to the return suction header.

13. The system of claim 11, further comprising pump means increasing the pressure of the refrigerant prior to passage thereof through said expansion valve.

14. The system of claim 8, further comprising pump means increasing the pressure without increasing the temperature of the refrigerant flowing from the high pressure receiver to the liquid supply header.

* * * * *